US012480748B2

(12) United States Patent
Laporte et al.

(10) Patent No.: US 12,480,748 B2
(45) Date of Patent: Nov. 25, 2025

(54) ADJUSTABLE LAUNCHERS

(71) Applicant: LAPORTE HOLDING, Biot (FR)

(72) Inventors: Jean-Michel Laporte, Biot (FR); Jean-Marc Fouques, Antibes (FR)

(73) Assignee: LAPORTE HOLDING, Biot (FR)

( * ) Notice: Subject to any disclaimer, the term of this patent is extended or adjusted under 35 U.S.C. 154(b) by 246 days.

(21) Appl. No.: 18/253,002

(22) PCT Filed: Nov. 5, 2021

(86) PCT No.: PCT/EP2021/080801

§ 371 (c)(1),
(2) Date: May 15, 2023

(87) PCT Pub. No.: WO2022/106224

PCT Pub. Date: May 27, 2022

(65) Prior Publication Data

US 2024/0003663 A1 Jan. 4, 2024

(30) Foreign Application Priority Data

Nov. 19, 2020 (FR) ..... 2011898

(51) Int. Cl.
*F41J 9/24* (2006.01)
*F41J 9/30* (2006.01)
*F41J 9/32* (2006.01)

(52) U.S. Cl.
CPC . *F41J 9/24* (2013.01); *F41J 9/30* (2013.01); *F41J 9/32* (2013.01)

(58) Field of Classification Search
CPC . F41J 9/18; F41J 9/20; F41J 9/24; F41J 9/30; F41J 9/32

(Continued)

(56) References Cited

U.S. PATENT DOCUMENTS 3,088,452 A * 5/1963 Foster ..... F41J 9/32
124/43
4,014,310 A * 3/1977 Laporte ..... F41J 9/18
280/38

(Continued)

FOREIGN PATENT DOCUMENTS

DE 202004013738 U1 * 12/2004 ..... F41J 9/32
FR 3095856 A1 11/2020
FR 3100879 A1 * 3/2021 ..... F41J 9/18

OTHER PUBLICATIONS

International Search Report issued in corresponding International Application No. PCT/EP2021/080801, dated Mar. 28, 2022, pp. 1-4, European Patent Office, Rijswijk, Netherlands.

(Continued)

*Primary Examiner* — Alexander R Niconovich
(74) *Attorney, Agent, or Firm* — HAUPTMAN HAM, LLP

(57) ABSTRACT

The device relates to a target projection machine for sports shooting, including a base, a throwing unit movable in rotation according to a first direction relative to the base, a throwing arm movable in rotation according to the first direction relative to the throwing unit, an actuator enabling an adjustment of the angular position of the throwing unit within an angular sector of rotational deflection according to the first direction relative to the base, the machine includes a system for adjusting the angular sector of deflection allowing selectively reducing the angular sector of deflection to one amongst a plurality of different predetermined angular sectors including at least a first angular sector, a second angular sector and a third angular sector.

16 Claims, 13 Drawing Sheets

(58) Field of Classification Search
USPC ..... 124/6, 8, 9
See application file for complete search history.

(56) References Cited

U.S. PATENT DOCUMENTS 5,249,563 A * 10/1993 Patenaude ..... F41J 9/30 124/8
5,470,078 A * 11/1995 Conlan ..... F41J 9/18 273/362
5,871,003 A * 2/1999 Laporte ..... F41J 9/30 124/8
5,937,839 A * 8/1999 Nilsson ..... F41J 9/24 124/8
6,026,796 A * 2/2000 LaPorte ..... F41J 9/18 124/8
6,176,229 B1 * 1/2001 Patenaude ..... F41J 9/18 124/8
6,276,350 B1 * 8/2001 Davey ..... F41J 9/18 124/8
6,588,410 B1 * 7/2003 Graber ..... F41J 9/24 124/8
7,263,986 B2 * 9/2007 Lovell ..... F41J 9/30 124/9
8,677,983 B2 * 3/2014 Callander ..... F41J 5/18 124/8
9,945,644 B2 * 4/2018 Fouques ..... F41J 9/24
11,733,007 B2 * 8/2023 Laporte ..... F41J 9/32 124/6
2011/0186023 A1 8/2011 Callander et al.
2015/0204638 A1 * 7/2015 Frazier ..... F41J 9/24 124/6

OTHER PUBLICATIONS

Written Opinion issued in corresponding International Application No. PCT/EP2021/080801, dated Mar. 28, 2022, pp. 1-10, European Patent Office, Rijswijk, Netherlands.

* cited by examiner

ADJUSTABLE LAUNCHERS

The present application is a U.S. National Phase of International Application Number PCT/EP2021/080801, filed Nov. 5, 2021, which claims priority to French Application No. 2011898, filed Nov. 19, 2020.

FIELD OF THE INVENTION

The present invention relates to the field of sports shooting and more particularly to target throwing machines. It finds a particularly advantageous application in the field of clay pigeon shooting and in particular the "Olympic trench" discipline.

TECHNOLOGICAL BACKGROUND

The "Olympic Trench" is a discipline of shooting in series. In general, it requires fifteen shooting machines called "launchers" divided into five groups of three as illustrated in FIGS. 1 and 2. Each launcher is accurately configured to project a target repeatedly according to a very accurate trajectory. Mechanisms have been proposed conferring manually adjustable orientations on the launchers. A machine of the prior art proposed by the applicant is illustrated in FIG. 3. This machine comprises a base 1 which is fixed relative to the ground and which supports the entire machine, including a throwing unit 3. The latter is the portion of the machine at which at least one target 4 could be projected by means of a throwing arm 32 movable in rotation about an axis of rotation 33, the target 4 being guided over a surface of a throwing plate 31. In general, the rapid projection movement of the throwing arm 32 is related to the release of the energy contained in a spring tensioned during a cocking cycle.

In order to reduce the number of machines in this sport, solutions have been proposed such as that of the document US2011/186023 A1 which discloses a shooting machine the throw of a disc thereby would be adjusted according to three parameters via three motor-driven actuators. In this prior art document, it is specified that it is possible to modify the projection angle, the projection height as well as the lateral position of the machine by translation on a rail. In the context of an Olympic trench event, this technical solution would theoretically have been suitable and thus replace fifteen throwers, nevertheless it has a major drawback in use thereof because it does not allow for a satisfactory speed of execution essential for a rapid sequence of shots and its adaptability to each shot is reduced. Indeed, the time separating two target projections according to two different directions should be short enough (for example the machine should be able to travel up to two meters in translation and/or 90° in horizontal rotation between two shots), and also, on this type of solution, the increase in the speed is necessarily accompanied by a loss of accuracy of the trajectories of the targets. The patent document DE 20 2004 013 738 U1 describes a target throwing machine including a support of a throwing unit mounted movable in rotation relative to a base by means of an actuator. The angular sector that the support could travel relative to the base is necessarily limited by the stroke of the actuator.

Hence, an object of the present invention is to provide a system allowing improving the responsiveness and the accuracy of machines intended for throwing targets in the context of an Olympic trench event.

The other objects, features and advantages of the present invention will appear upon reviewing the following description and the appended drawings. It should be understood that other advantages could be incorporated. It is understood that other advantages can be incorporated therein.

SUMMARY OF THE INVENTION

To achieve this objective, according to one embodiment, a target throwing machine for sports shooting is provided, comprising:

- a base,
- a throwing unit movable in rotation according to a first direction relative to the base,
- a throwing arm movable in rotation relative to the throwing unit,
- an actuator enabling an adjustment of the angular position of the throwing unit within an angular sector of rotational deflection according to the first direction relative to the base,
- characterised in that it includes a system for adjusting the angular sector of deflection allowing selectively reducing the angular sector of deflection to one amongst a plurality of different predetermined angular sectors comprising at least a first angular sector, a second angular sector and a third angular sector.

Therefore, the adjustment allows reducing the angular deflection and thus the throwing arm moves only a few degrees to reach the desired throwing angle. Therefore, the device is more accurate and the target is projected according to the intended trajectory. The adjustment system enables at least three distinct configurations for the same machine, which also enables multiple use of a universal launcher and thus a reduction in production costs. The reduction of the angular sector to be covered allows limiting the speed of the actuator and therefore selecting actuators, in particular cylinders, that are more stable in the stationary position even in the event of a power cut-off; typically, the power transmission lines are actually more irreversible and thus avoid parasitic movements due to the forces applied by the elements of the machine.

The technical solution thus proposed allows for a better responsiveness and a better accuracy of the target throwing machines.

According to one aspect, the actuator enabling the adjustment of the angular position of the throwing unit with respect to the base is a cylinder, advantageously an electric cylinder, which consequently has a limited stroke of its rod, so that the angular sector of movement of the throwing unit that the actuator could produce in a given position is limited by this stroke and/or a maximum stroke target that one wish to assign to the cylinder. Thus, in general, the actuator has a predetermined maximum stroke.

In a genuine way, it is suggested herein to modify the position of the actuator so as to have several angular sector(s) of deflection of the throwing unit with respect to the base. What is more, in particular in the case of Olympic trench shooting, this allows having angular sectors that are not complementary on a trigonometric circle, but overlapping, and suited to the characteristics of this type of shooting practice. Thus, the movement of the actuator is optimised in each of the desired angular sectors, with a reduced cylinder stroke allowing for a good responsiveness.

Another separable aspect relates to a system comprising three machines, wherein the three machines are pre-configured to respectively cover an angular sector of deflection amongst a plurality of different predetermined angular sectors. These machines may be identical except with regards to the angular sector of rotational deflection. A given angular sector may be assigned to each machine (different from that of the other machines), without the possibility of sector adjustment, yet, preferably, these machines are adjustable and are adjusted separately to produce this difference in the angular sector.

Another aspect relates to a method for pre-adjusting a machine comprising a step of selectively adjusting the angle of deflection according to the first direction amongst the plurality of different angular sectors.

BRIEF DESCRIPTION OF THE FIGURES

The aims, purposes, characteristics and advantages of the invention will be better understood upon reading the detailed description of one embodiment thereof, which is illustrated by means of the following accompanying drawings, in which.

Figure 1:
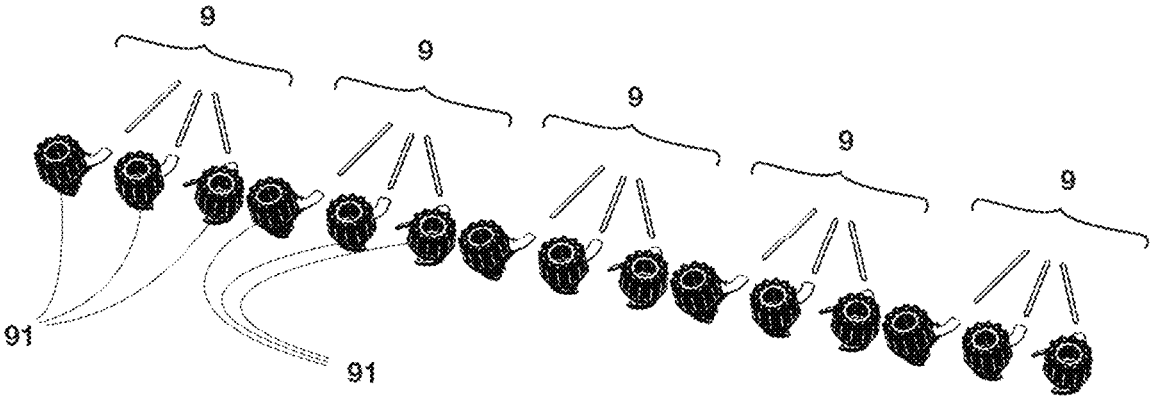
FIG. 1 represents an example of a throwing system for the Olympic trench as found in the prior art comprising five sets of three launchers.

The drawings are provided by way of example and are not intended to limit the scope of the invention. They constitute diagrammatic views intended to ease the understanding of the invention and are not necessarily to the scale of practical applications.

DETAILED DESCRIPTION

Before starting a detailed review of embodiments of the invention, optional features that may be used in combination or alternatively are set out hereinafter:

According to one example, the adjustment system is configured to modify the position of the actuator.

This enables an advantageous optimisation of the orientation of the actuator according to the selected angular sector of deflection. Indeed, the actuator is thus ideally positioned in order to maximise its efficiency According to one example, the actuator 71, 72, 73 is an electric cylinder.

According to one example, the adjustment system comprises a plurality of anchoring points where at least one anchoring unit of the actuator 71, 72, 73 is able to cooperate alternately. Preferably, the anchoring unit is at one end of the actuator, for example at the distal end of a cylinder rod or at the rear end of a cylinder body.

According to one example, an adjustment system is configured to modify an anchoring point of the first actuator 71 on the base 1.

According to one example, an adjustment system is configured to modify an anchoring point of the first actuator 71 on the throwing unit 3.

Preferably, the adjustment system is configured to modify a distance separating an anchoring unit of the actuator on an anchoring point of the base 1 and an anchoring unit of the actuator on an anchoring point of the support 2. In other words, the distance separating the anchorage of the actuator on the support 2 and the anchorage of the actuator on the base is modified using different anchoring points, at least on one amongst the base and the support.

Possibly, an anchoring unit may equip one end of an actuator and another anchoring unit may equip the other end of the actuator. By anchoring unit, it should be understood any element able to ensure a connection between the actuator and a portion of the machine amongst the base and the support. By anchoring point, it should be understood any element able to cooperate with an anchoring unit to ensure the connection. Typically, such a connection could be a pivot connection according an axis parallel to that of the rotation offered by the considered actuator.

According to one example, a second actuator 72 enables an additional adjustment of the angular position of the throwing unit 3 within an angular sector of rotational deflection according to a second direction 36, enabling an inclination of the throwing unit 3 with respect to the base 1, the first direction being different from the second direction According to one example, an energy accumulation spring allows moving the throwing arm 32 and the machine further comprises a system for varying the tension of the spring, the system is configured so as to keep a constant projection distance and that being so regardless of the angular position adjusted by the second actuator 72 within a sector of rotation according to the second direction 36.

According to one example, the three machines are disposed so that a central machine is centred between two lateral machines and the angular sectors of the lateral machines are symmetrical with respect to a shooting direction 34 of the central machine.

According to one example, the predetermined angular sectors 61, 62, 63 intersect.

According to one example, the step of selective adjustment of the deflection angle is performed by modifying the position of the first actuator 71.

According to one example, a machine is used comprising an actuator 71, 72, 73 which comprises an anchoring unit able to cooperate with a fastening element on an anchoring point amongst several anchoring points on one amongst the base 1 and the support 2 to enable the selective adjustment step.

It is specified that in the context of the present invention, the term "launcher" is sometimes used instead of "machine" as a claimed object, these terms should be considered as equivalent.

In the context of the invention, the accuracy of positioning of the different components of the launchers in the assembly depends on the accuracy of the shot and thus the backlashes of the mechanisms are likely to cause theoretical lateral discrepancies in the trajectories of the targets for two identical machines. For example, once could notice a 25 cm lateral deviation for a 76 m shot. Hence, it is appropriate to accept a target trajectory deviation margin between two machines having the same adjustments. Hence, these deviations will be taken into account when two trajectories are considered as identical. The acceptable fallout uncertainty of the target may also correspond to a 2 m sided square centred at 76 m from the launcher.

In the context of the invention, by "radial orientation" or "radially", reference is made to the positioning of an element movable in rotation relative to an axis.

In the rest of the description, the term "on" does not necessarily mean "directly on". Thus, when it is indicated that a part or a member A bears "on" a part or a member B, this does not mean that the parts or members A and B are necessarily in direct contact with the other. These parts or members A and B can either be in direct contact or bear on one another through one or more other part(s). The same applies for other expressions such as the expression "A acts on B" which could mean "A acts directly on B" or "A acts on B through one or more other part(s)".

In the present patent application, the term movable corresponds to a rotational movement or to a translational movement or to a combination of movements, for example the combination of a rotation and a translation.

In the present patent application, when it is indicated that two parts are distinct, this means that these parts are separate. They are:

- positioned at a distance from each other, and/or
- movable relative to each other and/or
- secured to each other by being fastened by added elements, this fastening being removable or not.

Hence, a one-piece unitary part cannot be formed by two distinct parts.

In the present patent application, the term "secured" used to describe the connection between two parts means that the two parts are connected/fastened with respect to each other, according to all degrees of freedom, except if is explicitly specified otherwise. For example, if it is indicated that two parts are secured in translation according a direction X, this means that the parts could be movable relative to each other except according to the direction X. In other words, if a part is moved according to the direction X, the other part performs the same movement.

In the present patent application, an elastic means may for example be a spring, such as a coil spring, elastic washers such as Belleville washers, an elastomer, a rubber.

Description of the Olympic Trench

As a reminder, and as illustrated in FIG. 1, a series of fifteen launchers 91 distributed along a line and advantageously oriented and configured, allow validating the standards required by the regulations of an official "Olympic trench" event. In the general case, the orientation of each of the launchers 91 is configured so as to remain the same throughout an event. Thus, each launcher 91 is able to throw a target 4 according to a pre-established projection, and adjusted so as to repeat the throw as faithfully as possible in order to obtain identical trajectories.

Figure 2:
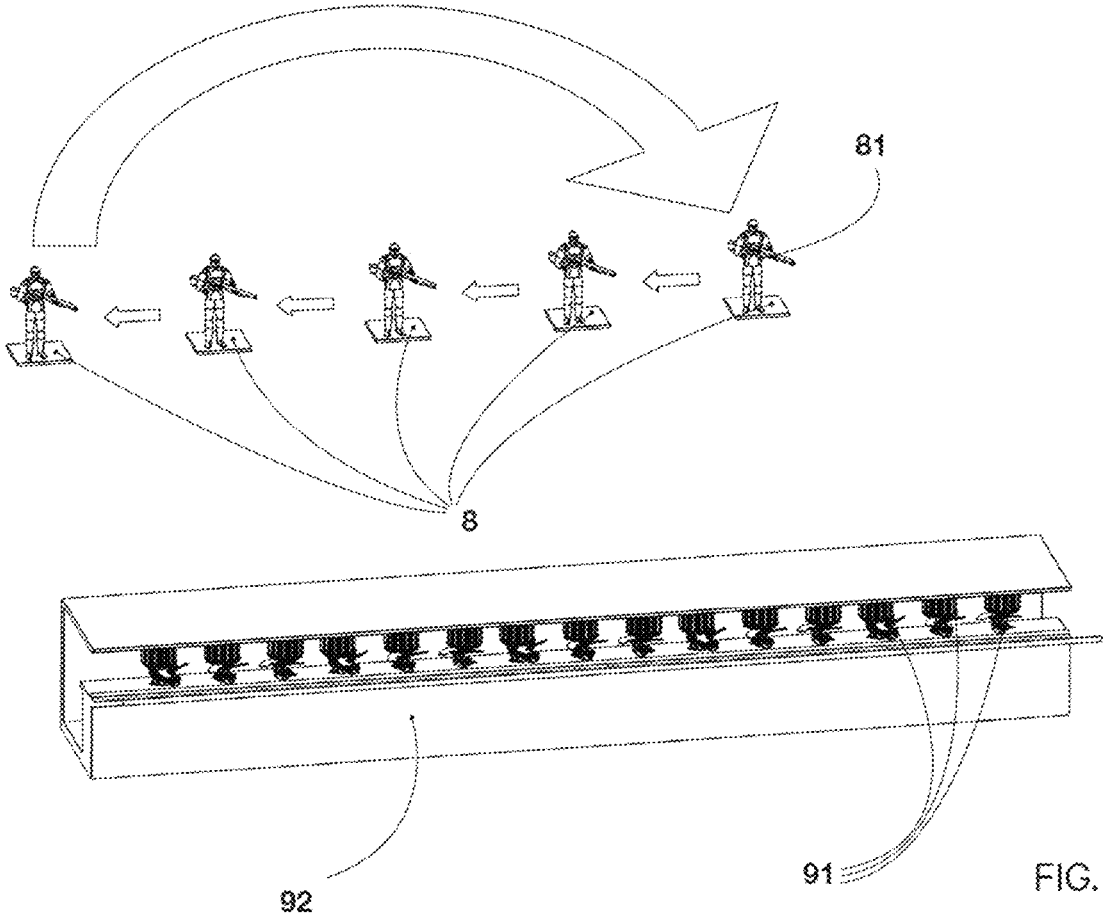
FIG. 2 represents an example of a throwing system for the Olympic trench as found in the prior art with a shooter moving on the different shooting platform locations.

As illustrated in FIG. 2, a shooter 81 moves throughout the event between the different locations of the shooting platform 8 in order to position himself in front of a combination 9 comprising three launchers 91 which are likely to randomly eject a projectile according to a predefined direction, either to the left, or to the right, or to the centre. Thus, the shooter does not know in advance which one of the three launchers 91 of the combination 9 will project a target 4.

Continuation of the General Problem

In order to significantly reduce the logistical costs of an "Olympic trench" event and as specified in the introductory part of the application, solutions have been provided comprising a unique adjustable launcher. Indeed, this allows avoiding the installation of fifteen different launchers. Yet, it has been noticed that one single launcher cannot, however, be enough to replace all of the fifteen launchers 91 since it has neither the responsiveness nor the accuracy required by the regulations for "Olympic trench" events or the consistency of target projection distance (in particular at 76 m for the Olympic trench).

Structural Description of a Launcher

Figure 3:
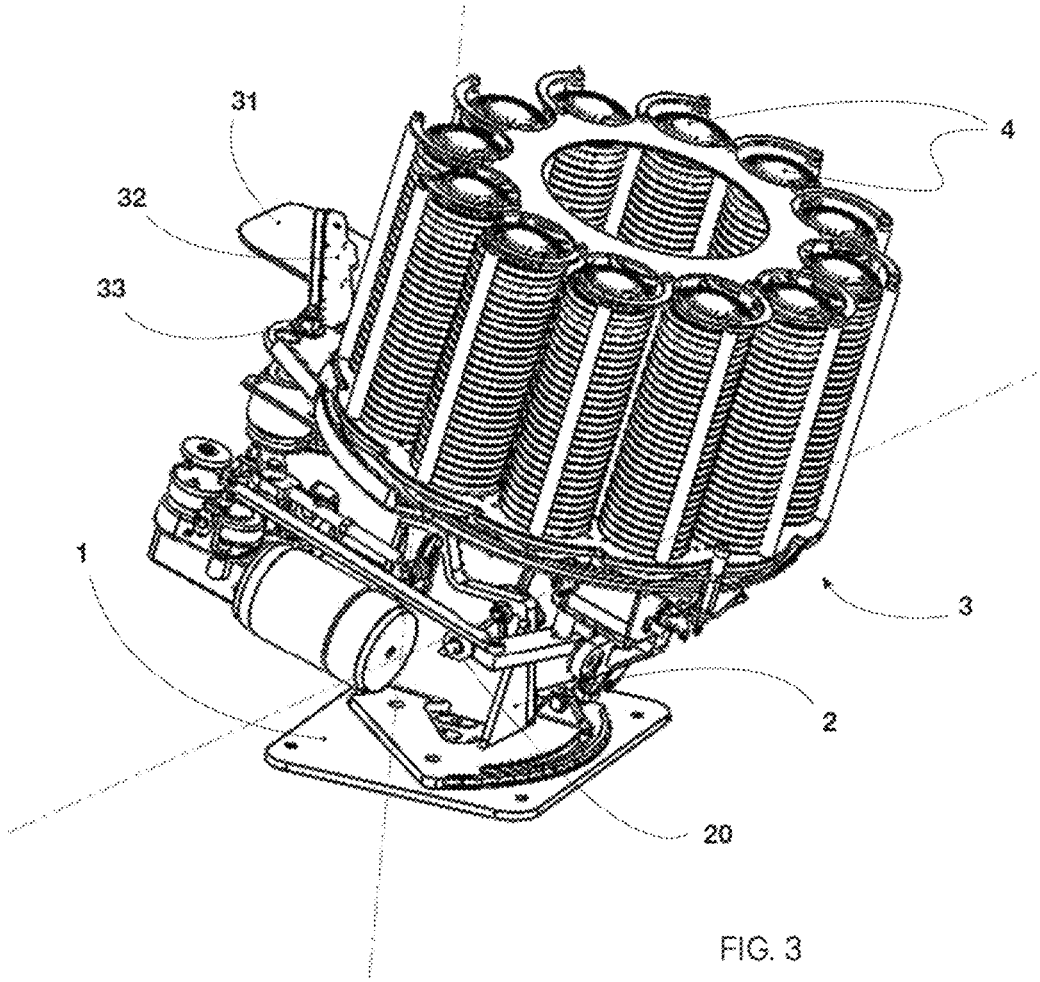
FIG. 3 represents a target launcher from the prior art.

Unless stated otherwise, the machine proposed herein may embed one or more aspect(s) of such a launcher. As illustrated in FIG. 3 and according to a specific example of a device from the prior art, the launcher 91 comprises a base 1 on which a throwing unit 3 is positioned through a support 2 movable in rotation relative to at the base via a support axis 20. The throwing unit comprises a throwing plate 31 as well as a throwing arm 32 movable in rotation relative to the throwing plate 31 through an axis 33. Advantageously, a target 4 is positioned on a throwing plate 31. Through an accelerated movement, the throwing arm 32 is brought to cooperate by contact with the target 4 in order to project it according to a pre-established trajectory.

Functional Description of a Launcher

According to this same example, the accelerated movement of the arm may be triggered by means of a mechanical actuator. Advantageously, it consists of an elastic means such as a tensioned spring. For example, when the spring is released, it triggers, by release of mechanical energy, an accelerated movement of the throwing arm 32 and the projection of the target 4 follows.

General Solution of the Invention

Figure 4A:
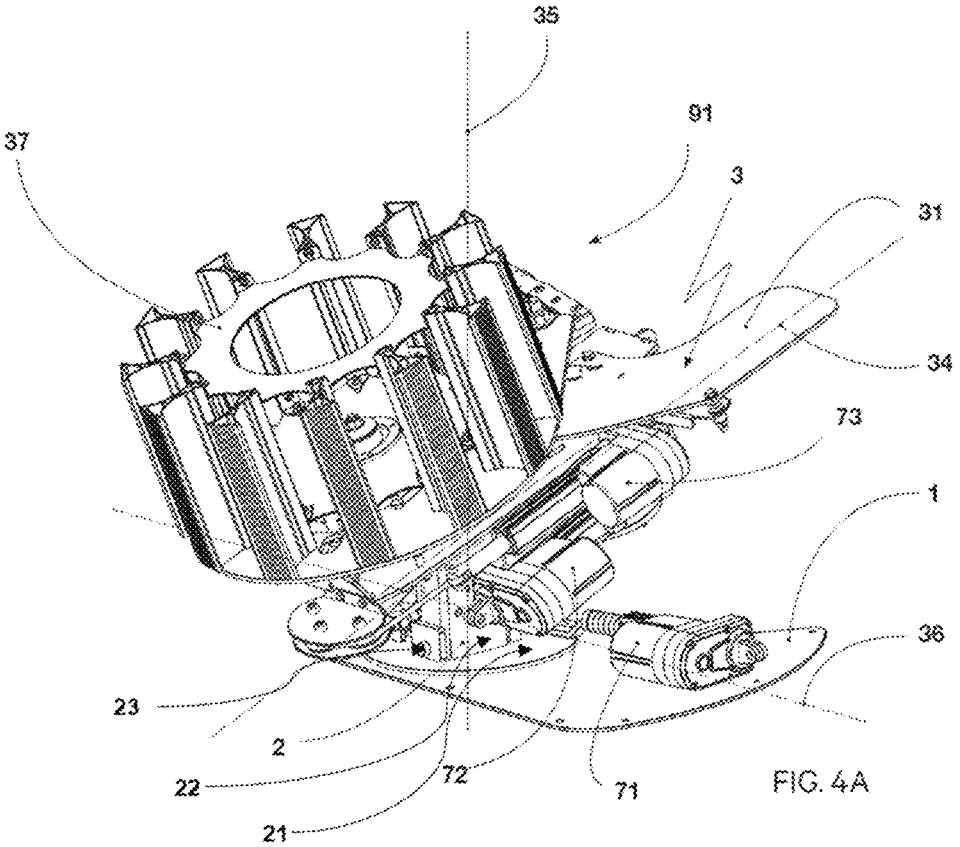
FIGS. 4A to 4B represent a launcher according to the present invention.
Figure 4B:
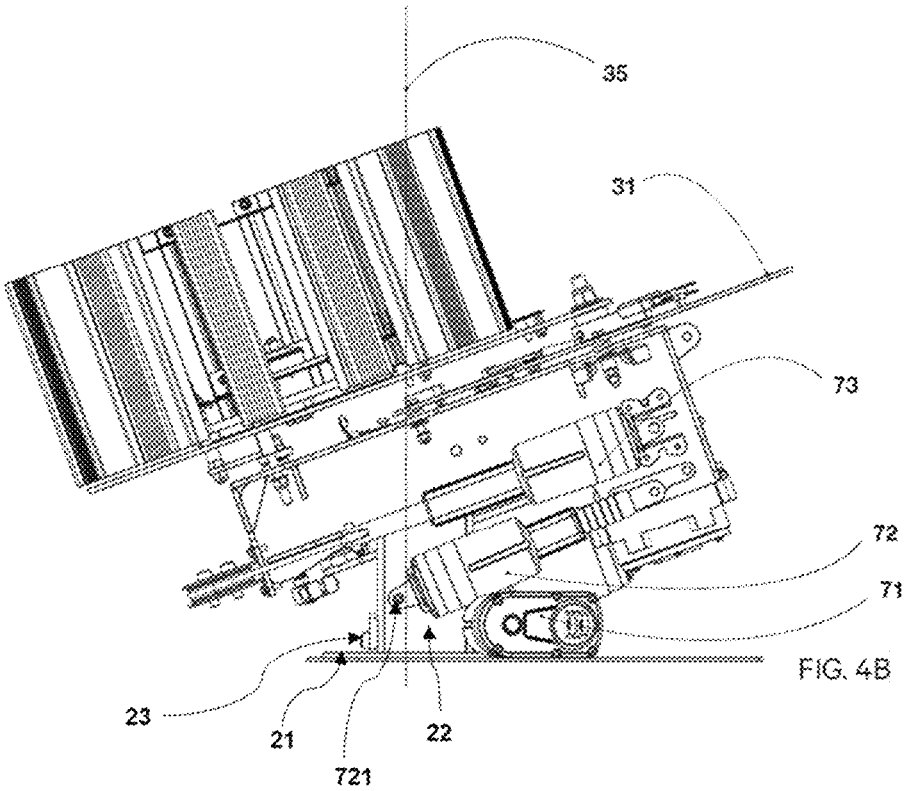

As illustrated in FIGS. 4A and 4B, and according to a preferred embodiment, the launcher 91 comprises a base 1 on which a support 2 is mounted supporting a throwing unit 3. The throwing unit 3 comprises a throwing plate 31 topped by a revolving cylinder 37 allowing reloading the targets 4 in an automated and continuous manner. The throwing unit 3 is movable in rotation relative to the support 2 according to at least one direction 36 so that the throwing plate is oriented according to a shooting direction 34 herein schematically represented in a purely illustrative manner. The support 2 is movable in rotation relative to the base 1 according to a direction 35. The first direction may be vertical in a position of use of the machine in a trench; the second direction 36 may be perpendicular to the first direction 35, it may consist of a direction of inclination with respect to a horizontal plane in a position of use of the machine in a trench.

According to this same embodiment, the support 2 and the throwing unit 3 are secured in rotation according to the first direction 35 and consequently, the orientation of the throwing unit 3 according to the first direction 35, is performed simultaneously with the rotation of the support 2 relative to the base 1. This rotation is performed in an automated manner and preferably semi-automatically using a motor-driven actuator 71. The orientation could be performed laterally or in height by tuning the rotations according to the directions 35, 36. However, one single rotational mobility may be enough.

According to one possibility, the support 2 includes two portions. One of the portions is in the illustrated case a plate 21 disposed on the base 1 and serving as an interface element with the latter. The base may itself be in the form of a plate, the two plates then being opposite each other, substantially parallel. The second portion of the support 2 visible in the figures is a post 22; the latter extends substantially transversely to the plate 21 so as to confer a vertical extension on the support 2; the post 22 may itself comprise or consist of a plate; at its end opposite to the plate 21, the post 22 ensures mounting of the throwing unit, for example by fastening a portion 38 of the body of the unit at this level. Preferably, a relative movement is nevertheless authorised between the post 22 and the throwing unit 3, by means of the second actuator 72, according to a second direction 36.

According to a non-limiting possibility, the support 2 thus formed also enables an adjustment of the inclination of the throwing unit 3 with respect to the base 1. Thus, as shown for example in FIG. 4A and in FIG. 4B, an axis of inclination 23 is present between the two portions of the support 2, so as to authorize a relative movement of these two portions according to a pivot connection. The plate 21 and the post 22 can be moved in rotation relative to one another so as to adjust the inclination of the post 22. Preferably, this adjustment is used to adjust the throwing attitude of the targets, in particular to adapt to the terrain on which the machine is positioned.

Figure 10A:
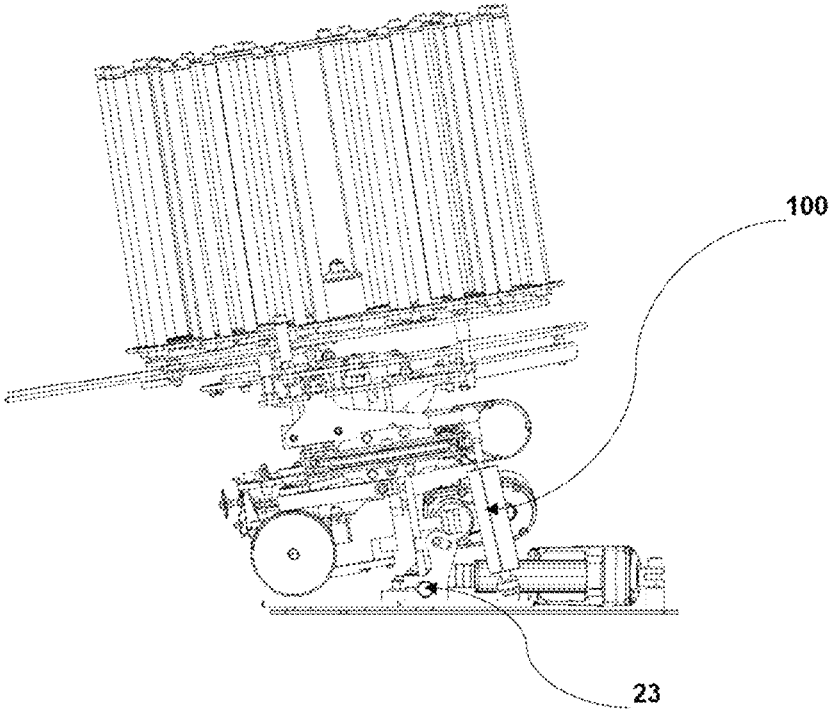
FIG. 10A is similar to the representation of FIG. 9A, in a different inclination situation.
Figure 10B:
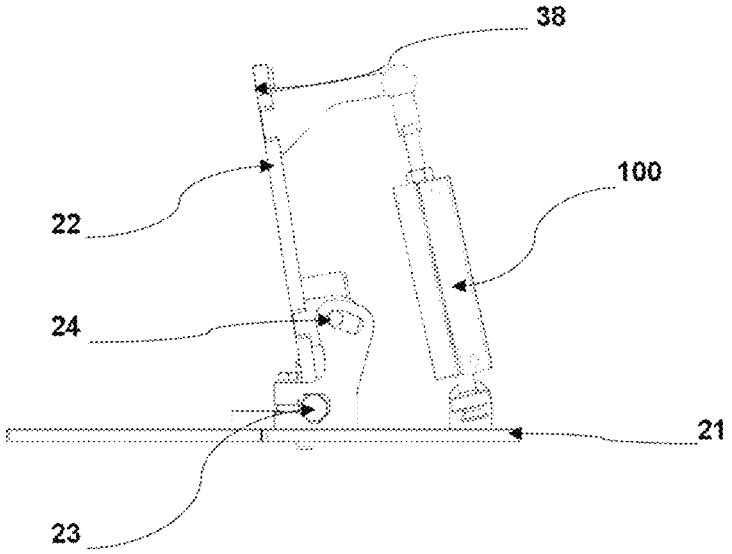
FIG. 10B is similar to FIG. 9B, but in the inclination position in accordance with FIG. 10A.

Preferably, once the inclination adjustment is completed, the post 22 is held in its inclined position for the shooting phases. Thus, in this option, the inclination is not intended to be dynamically modified during shooting practice. As shown in FIGS. 7A to 7F, the adjustment may be done by means of an axis of inclination 100 also visible with reference to FIGS. 10A to 11. The axis 100 is herein an element with a threaded rod whose projecting portion is adjustable with respect to a body; it should be understood that the rotation of the body relative to the rod allows modifying the length of the axis 100.

A first end 101 of the axis 100 is mounted on the plate 21, in an articulated manner, for example by a ball-joint connection or one or more pivot(s) with different axes. The same applies to the second end 102 this time mounted on the post 22, for example at a branch transverse to a vertical extension portion of the post 22.

Preferably, the amplitude of inclination adjustment is limited by means of an inclination limiter 24 which may comprise a lug secured to one amongst the plate 21 and the post 22 moving in an oblong hole of a portion secured to the other one amongst the plate 21 and the post 22. The oblong hole length determines the adjustable inclination amplitude, for example within an interval limited to 10°.

Thanks to this inclination arrangement, the attitude of the machine can be modified according to this additional axis 23. Preferably, the latter is perpendicular to the direction 35. Moreover, it is advantageously parallel to the surface of the plate 21. Also preferably, the axis 23 is perpendicular to the second direction 36. FIGS. 9A to 10B show two examples of inclination.

One could also consider a target projection power adjustment 4.

By motor-driven actuator 71, 72, 73, it should be understood any type of powered element intended to produce a mechanical movement by energy transformation. For example, this may consist of a hydraulic or electric power supply. The term "motor-driven" means a non-manual drive. An actuator may comprise a rod or arm movable in translation on command. It may consist of the rod of a cylinder, or a rod of a crank-rod system whose rotation is imparted by the output shaft of an engine.

According to this example, the launcher 91 is advantageously adjustable according to two and possibly three parameters and these adjustments are performed automatically. This enables the same launcher 91 to randomly project targets 4 according to a multitude of different programmed trajectories. These adjustments could then be performed in real-time during the "Olympic trench" event such that they enable an optimised configuration of the launchers.

Thus, according to this example, the invention provides a technical solution alternative to those of the prior art based on one group of three optimised launchers 91. Advantageously, this technical solution requires only one shooting point 9 since after each target projection 4, the trajectories of the three launchers 91 are preferably modified automatically, for example in less than eight seconds. The shooter 81 no longer needs to move, the combination 9 of three throwers 91 is capable of replicating, in a cyclic manner, the fifteen trajectory variants in accordance with the requirements of the regulations for "Olympic trench" events.

According to one embodiment, the base 1 comprises a planar surface parallel to the ground and the main direction 35 can be modelled by an axis perpendicular to the ground. Advantageously, the height of the machine is vertical when a launcher 91 is positioned for an Olympic trench event.

Actuators

In order to enables at least partial automation of the adjustments of the trajectory of a target 4, the rotation of the throwing unit 3 according to the first direction 35 using a first actuator 71, enables an automated lateral adjustment of the launcher 91. According to an example complementary to the preferred embodiment and as illustrated in FIG. 4B, the throwing unit 3 is movable in order to enable an adjustment of the inclination of the throwing plate 31 and consequently of the angle of ejection of the targets 4. This adjustment being performed using a second actuator 72. Finally, according to an example also compatible with the preferred embodiment, the launcher 91 comprises a third actuator 73 enabling an adjustment of the projection power of the target 4.

Anchorage of the Actuator

According to the preferred mode of the invention, the first actuator 71 enables an adjustment of the orientation of the base according to the direction 35 and therefore the first actuator 71 radially orients the throwing unit 3.

Figure 6:
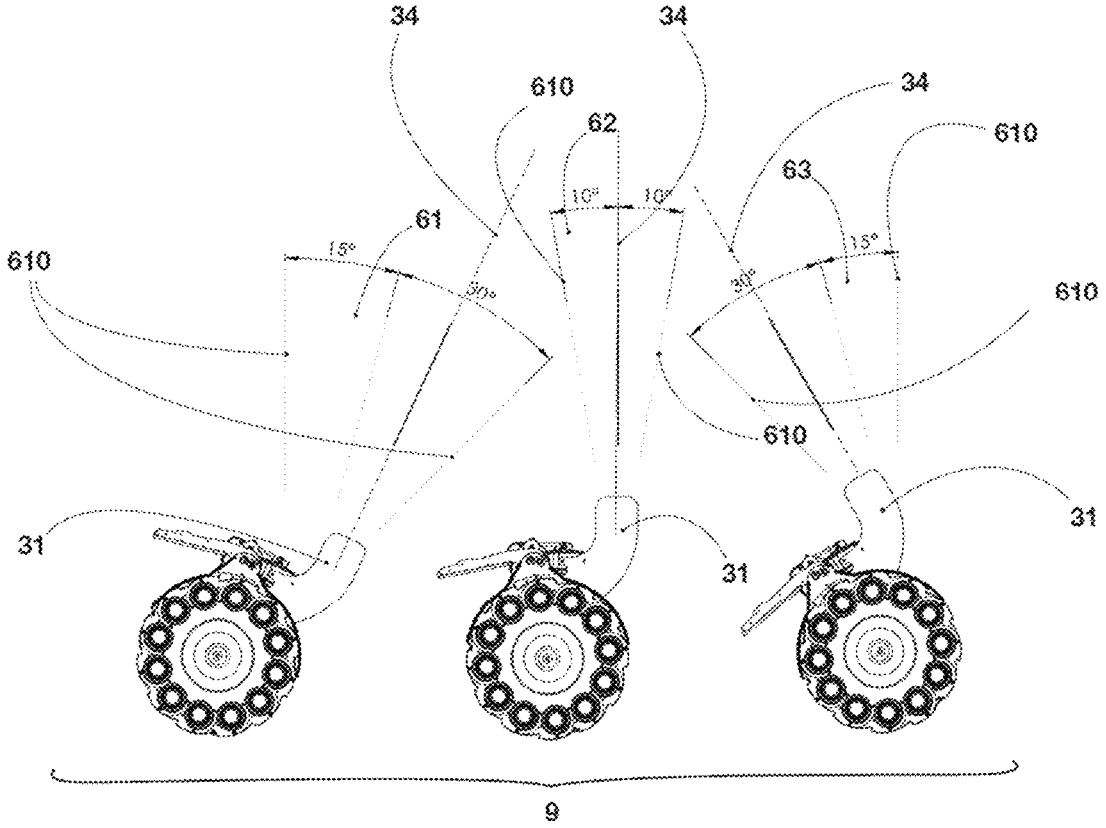
FIG. 6 represents the angular sectors of deflection of the three launchers illustrated in FIG. 5.

As illustrated in FIG. 6 and in order to allow for a better responsiveness and a better accuracy of the launcher 91, the lateral adjustment of each launcher 91 is deliberately reduced and limited between two lateral limits 610 and therefore defines a first angular sector of deflection. In the case of the Olympic trench, advantageously, the three machines are able to shoot according to a throwing direction right to the machine, with no angle, opposite the shooter; indeed, it is advantageous for the angular sectors of each of the three machines to partially overlap. The preferred embodiment, particularly suited to the Olympic trench and illustrated, implements three machines, but the invention does not exclude more than three machines, in a context of different shooting typologies in particular.

Thus, the launcher 91 is configured according to an angular sector of deflection 61, 62, 63 amongst a plurality of different predetermined angular sectors comprising at least a first angular sector 61, a second angular sector 62 and a third angular sector 63.

Figure 5:
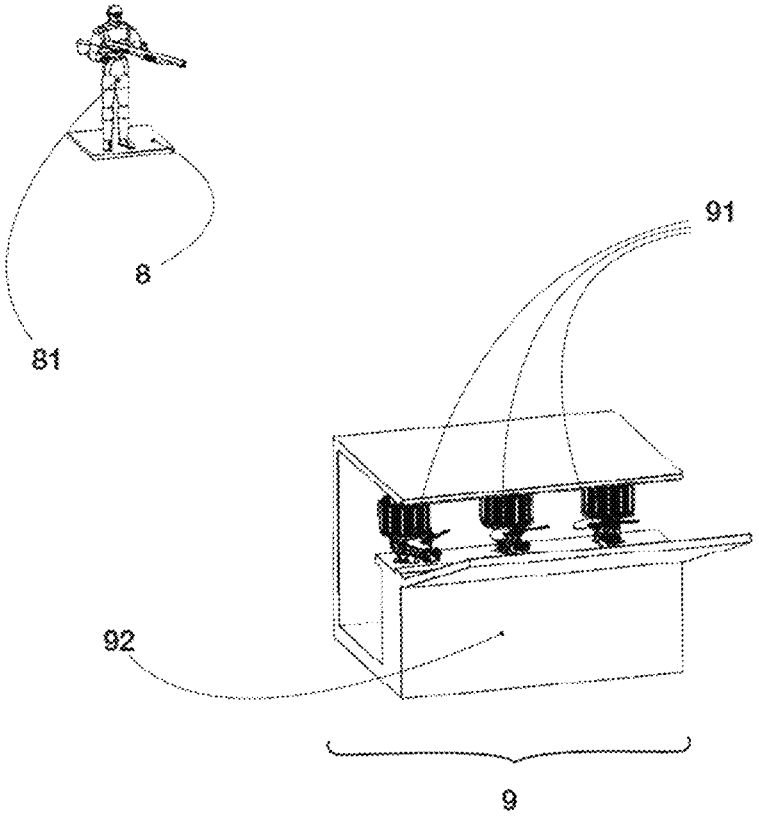
FIG. 5 represents a combination of three launchers according to the present invention.

Preferably, each launcher 91 is predefined according to a different angular sector. Preferably, the angular sector will be smaller than or equal to 60° and preferably smaller than or equal to 30°. According to one example and as illustrated in FIGS. 5 and 6, in a combination 9, the three launchers 91 are aligned, preferably along a line perpendicular to a median direction passing through the shooting station and the machine located in the centre, the back of the launcher at the centre is oriented so as to face the shooter 81 so that its median shooting direction 34 is aligned with the position of the shooter 81 and its angular sector of deflection 62 is equal to 20° in total advantageously split into two angular sectors of 10° symmetrical with respect to the shooting direction 34. Preferably, the other two launchers 91 are also distributed so that their angular sector is disposed symmetrically with respect to the throwing direction right to the machine, with no angle, opposite the shooter, at a line at the median direction of projection of the central launcher 91 and possibly their angular sectors extend over 30° or 60°. Advantageously, the machine located to the right of the central machine has an angular sector of deflection at least primarily, and possibly completely, directed to the left, unlike the machine to the left.

According to one example, the actuator 71, 72, 73 comprises at least one anchoring unit, preferably located on at least one end. Advantageously, the anchoring unit is pivotable relative to the actuator 71, 72, 73, for example thanks to a system of simple bearings. The anchoring unit is formally configured so as to be able to cooperate with fastening elements on at least one anchoring point, preferably on three different anchoring points. The anchoring unit comprises a residual mobility to facilitate mounting and dismount of the actuator 71, 72, 73. For example, the anchoring unit may comprise a hook, an opening, an attachment system.

According to a non-illustrated example, the system for adjusting the angular sector of deflection comprises a pathway through an oblong hole able to cooperate with a fastening system, which may for example be a bolt element like a screw and/or a nut.

Advantageously, the pathway takes on a curved trajectory. Preferably, on an anchoring point, the actuator 71, 72, 73 may be dismounted from a first anchoring point by loosening then reassembled and held in position in a second anchoring point by tightening, preferably by screwing.

According to one example, the anchoring unit comprises an opening, a hook or a ball, able to cooperate with receiving elements positioned at the anchoring points. Preferably, the receiving elements being rods, hooks, or any other mechanical element facilitating the set-up and holding in position of an actuator 71, 72, 73.

According to one embodiment, the first actuator 71 is an electric cylinder. Advantageously, it comprises two anchoring units, one of which is secured to the support 2 and the other one is located in contact with the base 1. Preferably, the anchoring unit located in contact with the base 1 is removable since it is located on one amongst three anchoring points.

According to one example, the base 1 is a plate, preferably metallic, which comprises a rounded protrusion at the anchoring points and each anchoring point defines a different angular sector of deflection.

Combinations

As illustrated in FIG. 5 and according to a preferred embodiment of the invention, a combination 9 comprises three launchers 91 arranged within the same shelter 92 or trench.

Shooting Angles

According to one embodiment and as illustrated in FIG. 6, the three launchers 91 are configured so as to be able to be oriented according to an angular sector of deflection 61, 62, 63 comprising a shooting direction 34 able to cover a different angular sector for each of the three machines.

Anchoring Points

According to one embodiment, each launcher has at least one angular sector of deflection 61, 62, 63 prior to an "Olympic trench" event. Preferably, these angular sectors are manually adjusted. Preferably, the actuator 71, 72, 73 is advantageously secured to two elements of the launcher 91 by two anchoring points. For a given actuator, it is advantageously the distance between the two anchors which is modified by the motor to vary the shooting angle (or the shooting power). Yet, to modify the angular sector of this motor-driven deflection, the position of at least one of the anchorages is adjusted, preferably manually. Thus, the launcher 91 is advantageously configured so that the at least one anchoring point of the actuator 71, 72, 73 could be easily dismounted from a first location then reassembled on a second location provided to this end. Thus, the at least one anchoring point of the actuator 71, 72, 73 could vary, and therefore enable an optimisation of the positioning of the actuator with respect to the desired shooting direction sector 34.

According to one embodiment, the dismount of the actuator at least at one anchoring point is performed using a mechanical fastening element which may be, for example, bolt parts, like for example a screw/nut system.

According to one embodiment, an adjustment clearance is provided at least at one anchoring point of the actuator 71, 72, 73 in order to facilitate fastening thereof on the base 1 or on the support 2. For example, this could consist of an oblong adjustment hole. According to a preferred embodiment, a combination 9 comprises three launchers 91 which differ only by the anchoring point of an actuator 7, preferably, it will consist of the first actuator 71.

According to one example, all launchers 91 are identical in that they include exactly the same components.

EXAMPLE ACCORDING TO A PARTICULAR EMBODIMENT

An example according to a particular embodiment is illustrated inn FIGS. 7A to 7F, wherein an actuator 71, 72, 73 is advantageously positioned in order to make a shooting direction 34 vary within a pre-adjusted angular sector of deflection 6. Indeed, the modification of the positioning of the actuator preferably makes another angular sector of the shooting direction 34 functional. In each of the three configurations provided for the angular sectors, the shooting direction 34 is included within the angular sector of deflection 61, 62, 63 which is adjusted.

According to this last example, the first actuator 71 is advantageously secured to the launcher 91 at two anchoring points. A first anchoring point is located on the support 2. A second anchoring point is located on base 1. According to a preferred embodiment, at this second anchoring point, the first actuator 71 is configured so as to be dismounted, then reassembled on at least one additional anchoring point, preferably two additional anchoring points, located on the base 1. According to one possibility, it is one end of the rod of a cylinder of the actuator 71 which is connected to an anchoring point of the support and one end of the body of the cylinder of the actuator 71 which is connected to an anchoring point of the base.

Figure 7A:
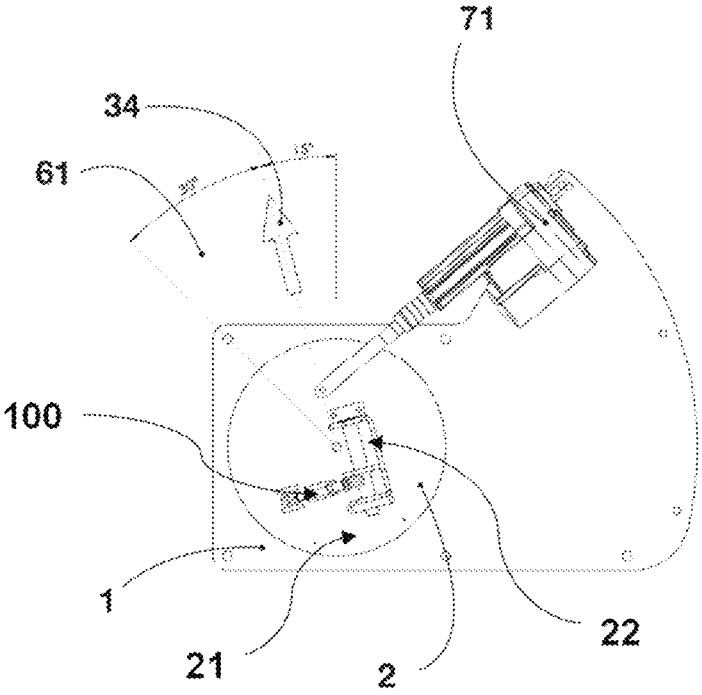
FIGS. 7A to 7F represent an adjustment of an anchoring point of an actuator in three different positions and according to the invention.

Preferably, the possible anchoring points of the base are differently spaced apart from the anchoring point of the support so that, in each of the situations represented in FIGS. 7A/7B, 7C/7D, 7E/7F, the length of the actuator between the two anchoring points is different. In the case of a cylinder, this corresponds to a different extension length of the rod of the cylinder in the three situations. In other words, the formation of each angular sector is performed by modifying the translational stroke sector of the actuator, and for example of the rod of a cylinder. The angular sectors may overlap, such that the translational stroke sectors of the actuator could also overlap but they are different.

Figure 7B:
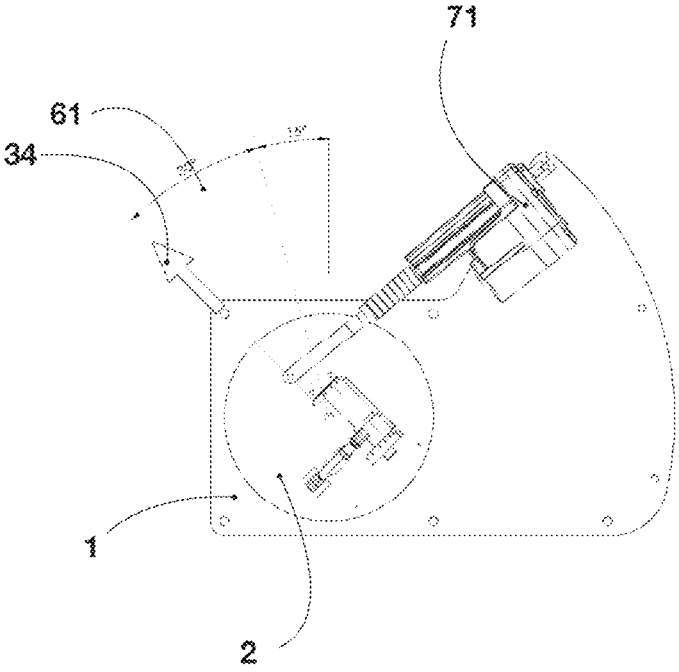

Thus, the machine of FIGS. 7A and 7B preferably corresponds to the machine on the right of FIG. 6. In general, the cylinder rod is more retracted than in the other two positions, of FIGS. 7C/7D and 7E/7F. Thus, in FIG. 7A, a shooting direction 34 is located in the sector 63. As the rod is more retracted, its extension deflection is larger, which enables an actuation of the support 2 primarily in a counterclockwise direction. This is what allows reaching the position represented in FIG. 7B which herein corresponds for example to a limit of the angular sector 63.

Figure 7C:
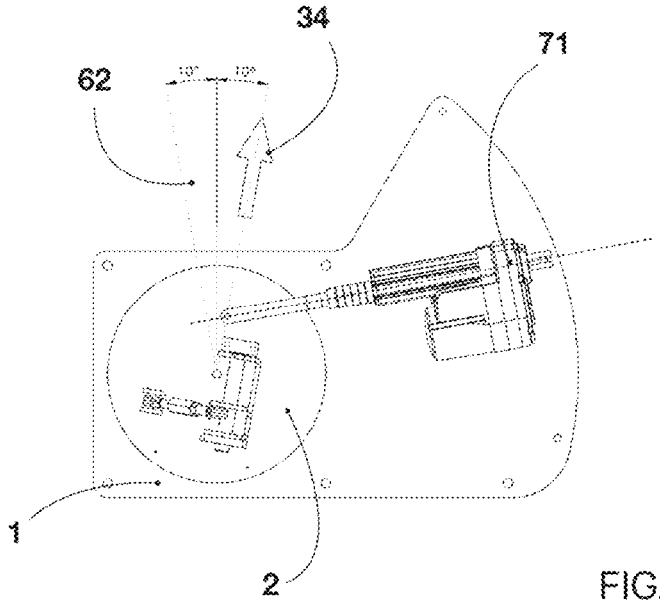
Figure 7D:
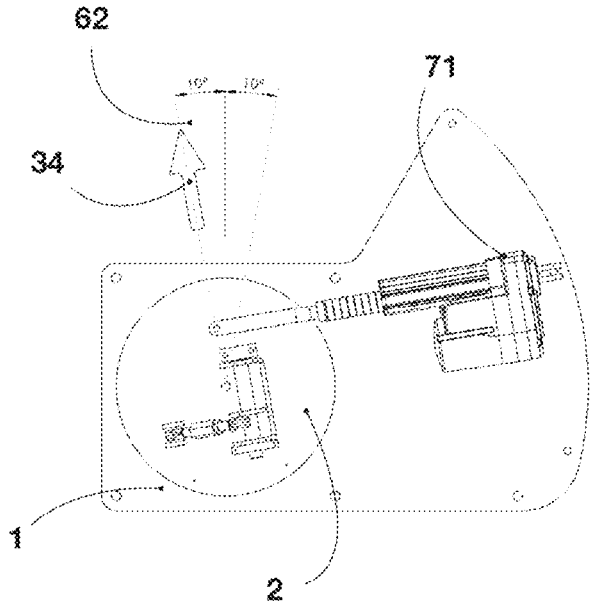

Preferably, the machine of FIGS. 7C and 7D corresponds to the machine in the middle of FIG. 6. The distance separating the two anchorages is shorter than in the previous case and this position is advantageously configured so that the rod could move in translation over strokes with an equivalent length in retraction or in extension around the represented position, which may correspond to a neutral position. The two extreme positions of the rod of the cylinder respectively correspond to the illustrations of FIGS. 7C and 7D to modify the shooting direction 34 in the sector 62 accordingly.

Figure 7E:
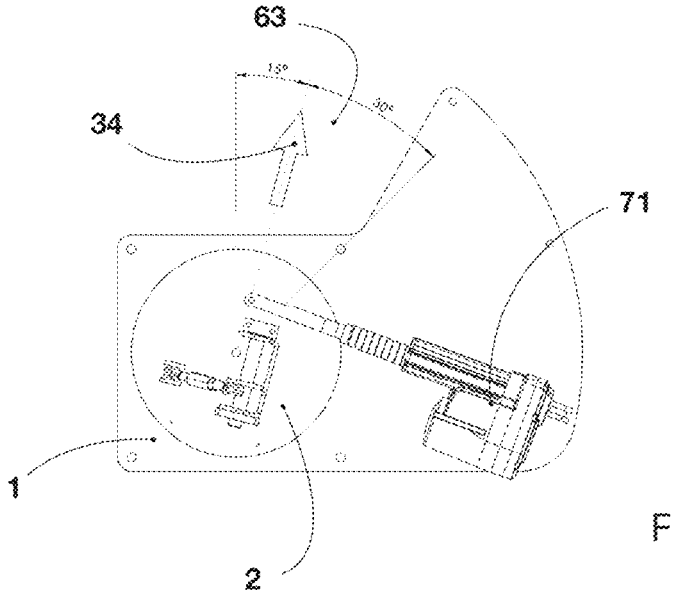
Figure 7F:
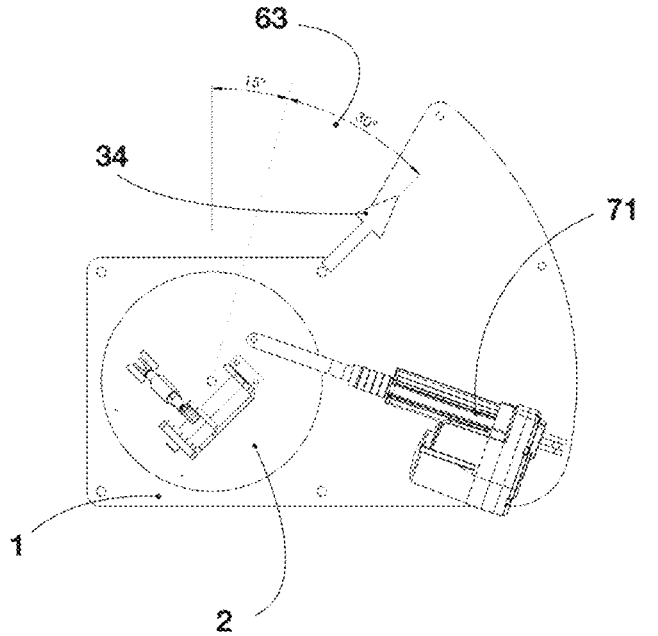

Finally, FIGS. 7E and 7F preferably correspond to the machine on the left in FIG. 6. This time, the distance between the anchors is maximum, such that the actuator 71 is the most extended in this position. In the case of a cylinder, it is in this situation that the rod is extended the most, for a throw right to the trench. On the other hand, the length of the retraction stroke of the rod of the cylinder is longer, which allows for a greater deflection in a counterclockwise direction. Thus, it is possible to operate a 30° movement in the sector 61 by a retracting movement of the rod of the cylinder from the shooting direction 34 of FIG. 7E to that of FIG. 7F.

As a result of the previous explanations, one aspect of embodiments of the machine allows modifying the length of the extending rod in a situation for a shot right to the trench by modifying at least one of the anchorages of the cylinder. Thanks to this modification, it is possible to modify the stroke of the cylinder in the direction of rod extension and the stroke of the cylinder in the direction of rod retraction. Thus, it is possible to make the actuator 71 of one of the machines work so that the covered angular sector is primarily induced by an extension translation of the rod. Furthermore, it is possible to make the actuator 71 of another machine work so that the covered angular sector is primarily induced by a retraction translation of the rod. What is more, the actuator 71 of another machine, preferably the central machine, could be made to work, so that the covered angular sector is distributed identically between the extension stroke and the retraction stroke of the rod of the cylinder.

The explanations given before are applicable mutatis mutandis to a deflection of parts movable in translation other than the rod of a cylinder, for example an arm of a crank-rod system.

Variants and Other Embodiments (Base on Rotating Carriage, Base on Translation Carriage Anchorage)

According to a particular embodiment, the base is removable and the actuator 71, 72, 73 may be non-removable. Preferably, the base is mounted on a carriage movable in rotation and whose rotation could be blocked according to three predefined anchoring points.

According to another embodiment, the base 1 is mounted on a carriage movable in translation.

Electric Cylinder

According to a preferred embodiment, at least one of the actuators 71, 72, 73 is an electric cylinder. Preferably, these may consist of 12V electric cylinders associated with sensors dedicated to the positioning of the actuators, which may be of the potentiometer, optical or Hall effect type. According to one example, the number of pulses per mm of stroke is 12,599 and the acceptable load is 6,000 N. In each angular sector 61, 62, 63, the stroke of the actuator may be short, for example less than 5 cm.

Angular Sectors of Deflection

Figure 8:
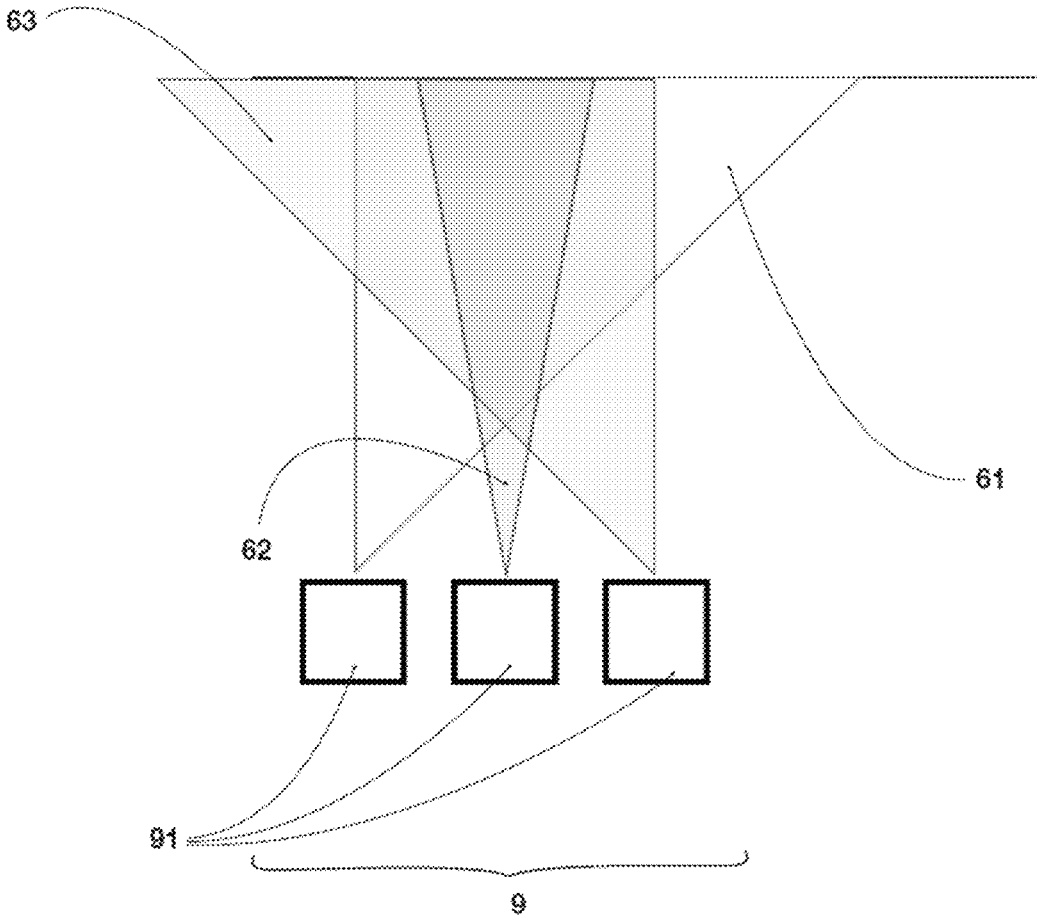
FIG. 8 represents in a view parallel to the ground a diagram in the form of an area of the angular sectors of deflection of a combination of three launchers according to the invention.
Figure 9A:
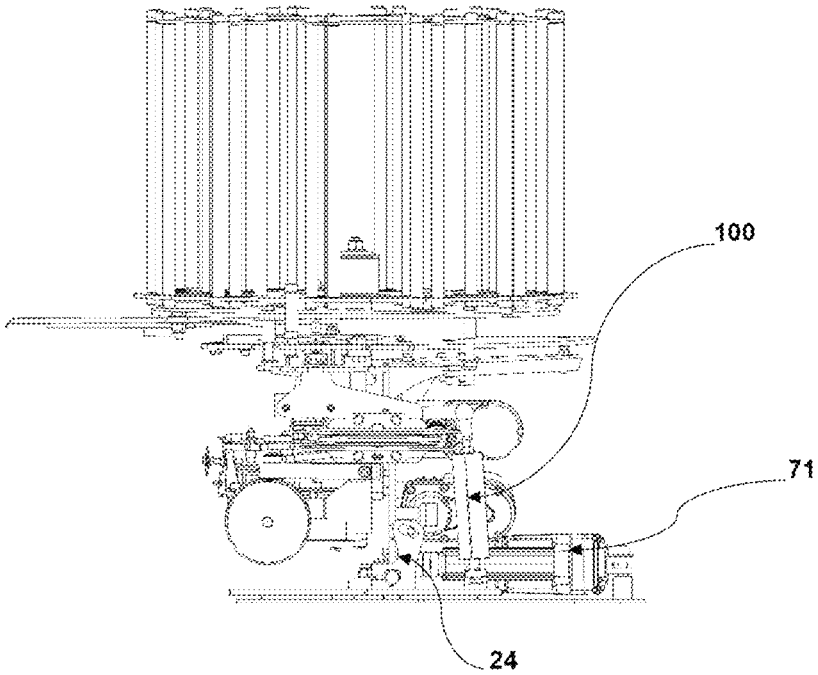
FIG. 9A represents a profile view of an embodiment of the throwing machine.
Figure 9B:
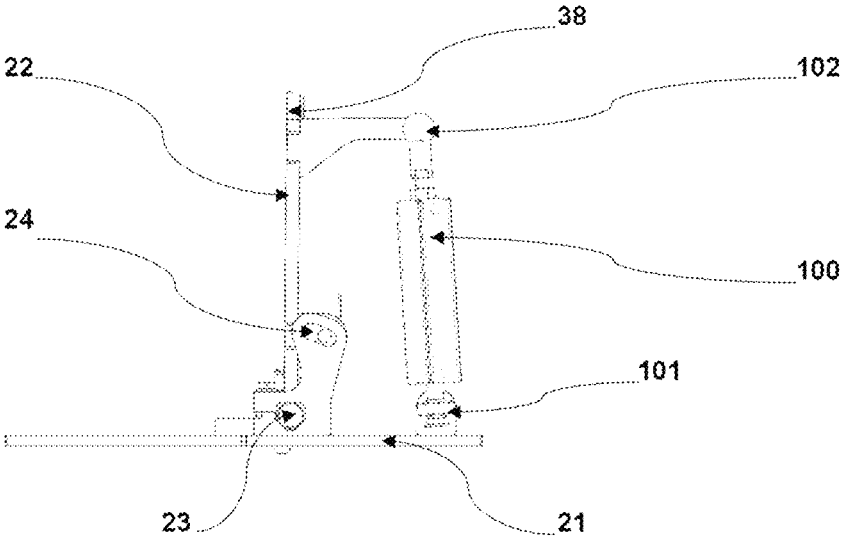
FIG. 9B provides a detail thereof, for the inclination of the throwing unit with respect to the base.

As illustrated in FIG. 8 and according to an embodiment of the invention, the combination 9 comprising three launchers 91 is configured so as to be able to project targets 4 according to three different angular sectors of deflection, a first angular sector 61, a second angular sector 62 and a third angular sector 63. The limitation of the rotational movements of the launchers in different angular sectors of deflection allows limiting the stroke of the actuators accordingly, this stroke being, for each angular sector, a predetermined maximum travel between two extreme positions of the rod of the actuator; the extreme position is not necessarily an end of travel, and could also consist of desired limits for the movement of the rod.

Second Adjustment Direction

Figure 11:
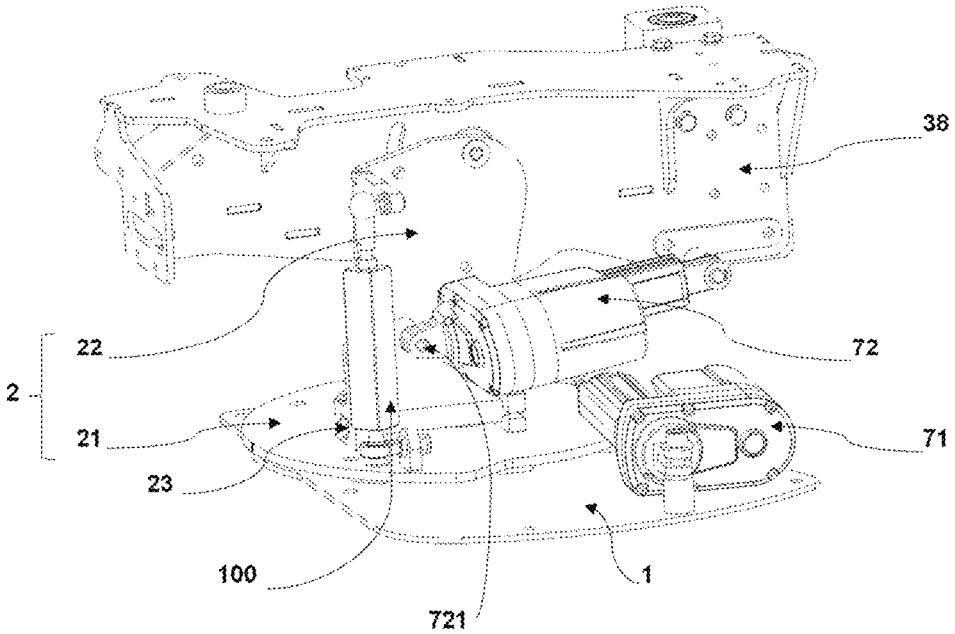
FIG. 11 provides a perspective view of one embodiment.

According to a particular embodiment wherein a first adjustment is configured to enable a disassembly of a first actuator 71 from a first location then reassembly of the first actuator 71 in a second location, the invention provides for least at one equivalent second adjustment to be performed on at least one second actuator 72. Possibly the launcher 91 is configured so as to enable an equivalent third adjustment of at least one third actuator 73. In the illustrated embodiments, the second actuator 72 has one end linked to the throwing unit, for example by a pivot connection. The other end is linked to the support 2, also for example by a pivot. As shown in FIG. 4A or FIG. 11, this end is attached to the support in an anchoring area 721. Preferably, the anchoring area 721 is located on the post 22 of the support 2. A potential interest is to raise the location of the second actuator 72 with respect to the base 20, for example to have a raised configuration of the second actuator 72 with respect to the actuator 71. Moreover, this arrangement makes the actuator 72 insensitive to modifications of the inclination about the axis 23, the actuator 72 being in this case, secured to the part that tilts. Hence, the different movements are better decoupled.

Power Adjustment

According to a particular embodiment, the launcher 91 comprises a system for varying the throw tension operating thanks to an elastic element and preferably a spring, typically a spring tensioned during a cocking phase. Preferably, the actuator 73 comprises an anchor connected to one end of the spring so that the tension of the cocked spring could be adjusted according to the position of this anchor.

Advantageously, the system is configured to keep a projection distance constant despite the modification of at least one angular position per actuator 7.

According to one embodiment, the origin of movement of the actuators 71, 72, 73 or the load of the spring(s) may be moved electronically within a computer member in order to compensate for the variations in trajectory due to altitude, winds or other meteorological parameters.

According to one embodiment, a sequencer controls the combination 9 comprising the three launchers 91. Preferably, it integrates the data relating to all trajectories and manages, for example, the evolution of the combinations during the shooting session for one or more shooter(s) 81. The sequencer may comprise a processor and a memory for storing instructions allowing executing actuator commands.

In the context of training and according to a particular embodiment, the sequencer also offers the possibility of selecting specific trajectories, repeating them, and modifying the difficulty thereof by decreasing or increasing the speed of projection of the targets 4, or by creating a customised shooting sequence.

According to one example, the sequencer also determines which launcher 91 should be activated for the upcoming shot.

According to one embodiment, the invention comprises an interface between the shooter and the sequencer. Preferably, it is a radio control comprising an emitter and a receiver, the emitter may for example be a "Lavalier microphone" in order to enable a departure of the target under voice command.

According to one embodiment, the invention provides for a hybrid solution wherein an "Olympic Trench" with three launchers 91, preferably arranged within a shelter 92.

The invention is not limited to the previously-described embodiments and covers all embodiments in accordance with its spirit.

REFERENCE NUMERALS

1. Base
2. Support
20. Axis
21. Plate
22. Post
23. Axis of inclination
24. Inclination limiter
3. Throwing unit
31. Throwing plate
32. Throwing arm
33. Axis of rotation
34. Shooting direction
35. First direction
36. Second direction
37. Revolving cylinder
38. Fastening portion of the unit body
4. Target
5. Adjustment system
61. First angular sector
610. Lateral limit
62. Second angular sector
63. Third angular sector
71. First actuator
72. Second actuator
721. Mounting area
73. Third actuator
8. Shooting platform
81. Shooter
9. Combination
91. Machine
92. Shelter
100. Adjustable axis
101. First end
102. Second end

The invention claimed is:

1. A target throwing machine for sport shooting, comprising:

a base, a throwing unit movable in rotation according to a first direction relative to the base, a throwing arm movable in rotation relative to the throwing unit, an actuator being an electric cylinder connected between the base and the throwing unit and arranged to rotate the throwing unit within an angular sector of rotational travel according to the first direction relative to the base, and a system for adjusting the angular sector of travel comprising an anchor cooperable with the actuator, the anchor being selectively engageable to limit the travel of the actuator so as to define a reduced angular sector of travel, the actuator being operable to switch between a plurality of predetermined angular sectors comprising at least a first angular sector, a second angular sector and a third angular sector, and the first angular sector, the second angular sector and the third angular sector overlapping and each being smaller than or equal to 60°.

2. The target throwing machine according to claim 1, wherein the adjustment system is configured to modify a position of the actuator.

3. The target throwing machine according to claim 1, comprising a support positioned intermediately between the base and the throwing unit, the support being movable in rotation with respect to the base and the throwing unit being positioned on the support, the support comprising a plate disposed on the base and a post mounted on the plate, the target throwing machine comprising a second actuator enabling an additional adjustment of the angular position of the throwing unit within an angular sector of rotation travel according to a second direction, enabling an inclination of the throwing unit with respect to the base, the first direction being different from the second direction, one end of the second actuator being mounted on the post.

4. The target throwing machine according to claim 3, wherein the post is adjustable in inclination around an axis of inclination with respect to the plate.

5. The target throwing machine according to claim 1, wherein the adjustment system comprises a plurality of anchoring points where at least one anchoring unit of the actuator is able to cooperate alternately.

6. The target throwing machine according to claim 5, wherein the adjustment system is configured to modify an anchoring point of the actuator on the base.

7. The target throwing machine according to claim 5, wherein the adjustment system is configured to modify an anchoring point of the actuator on the throwing unit.

8. The target throwing machine according to claim 5, wherein the adjustment system is configured to modify a distance separating an anchoring unit of the actuator on an anchoring point of the base and an anchoring unit of the actuator on an anchoring point of the support.

9. The target throwing machine according to claim 1, wherein the throwing unit comprises an energy storage spring in order to move the throwing arm and the target throwing machine further comprises a system for varying a tension of the energy storage spring.

10. The target throwing machine according to claim 9, further comprising a support positioned intermediately between the base and the throwing unit, the support being movable in rotation with respect to the base and the throwing unit being positioned on the support, the support comprising a plate disposed on the base and a post mounted on the plate, the machine comprising a second actuator enabling an additional adjustment of the angular position of the throwing unit within an angular sector of rotation travel according to a second direction, enabling an inclination of the throwing unit with respect to the base, the first direction being different from the second direction, one end of the second actuator being mounted on the post, wherein the system for varying is configured to keep a constant projection distance regardless of the angular position adjusted by the second actuator within a sector of rotation according to the second direction.

11. A system for sport shooting comprising three target throwing machines according to claim 1, wherein the three target throwing machines are pre-configured to respectively cover a different angular sector of travel among the plurality of different predetermined angular sectors.

12. The system for sport shooting according to claim 11, wherein the three target throwing machines comprise a central target throwing machine and two lateral target throwing machines, wherein the three target throwing machines are disposed so that the central target throwing machine is centered between the two lateral target throwing machines and the angular sectors of the lateral target throwing machines are symmetrical with respect to a shooting direction of the central target throwing machine.

13. The system for sport shooting according to 11, wherein the predetermined angular sectors intersect.

14. A method for pre-adjusting a target throwing machine according to claim 1, comprising a step of selectively adjusting the angle of deflection travel according to the first direction among the plurality of different angular sectors.

15. The method according to claim 14, wherein the step of selectively adjusting the angle of travel is performed by modifying a position of the actuator.

16. The method according to claim 14, wherein a target throwing machine is used comprising an actuator which comprises an anchoring unit able to cooperate with a fastening element on an anchoring point amongst several anchoring points on one amongst the base and a support to enable a step of selectively adjusting the angle of travel.

* * * * *